United States Patent [19]

Djukastein

[11] 4,298,464

[45] Nov. 3, 1981

[54] ROCK SEPARATOR

[75] Inventor: Klaus Djukastein, Sidney, Canada

[73] Assignee: Deroker Equipment Ltd., Sidney, Canada

[21] Appl. No.: 146,004

[22] Filed: May 2, 1980

[51] Int. Cl.[3] ..... B07B 1/28

[52] U.S. Cl. ..... 209/310; 209/380; 209/392

[58] Field of Search ..... 209/235, 236, 254, 261–263, 209/269, 310, 392, 380

[56] References Cited

U.S. PATENT DOCUMENTS

| | | | |
|---|---|---|---|
| 580,067 | 4/1897 | Stubbs et al. | 209/310 |
| 1,958,322 | 5/1934 | Symington | 209/310 |
| 3,454,162 | 7/1969 | Cover | 209/269 |
| 4,190,527 | 2/1980 | Spiller | 209/392 X |

FOREIGN PATENT DOCUMENTS

| | | | |
|---|---|---|---|
| 299102 | 10/1928 | United Kingdom | 209/310 |

*Primary Examiner*—William A. Cuchlinski, Jr.
*Attorney, Agent, or Firm*—Berman, Aisenberg & Platt

[57] ABSTRACT

A device for primary separation of valuable ore material from gravel or other waste in placer mining prior to sluicing. The separator comprises a frame having sides and front and back ends and adapted to be inclined at an angle to the horizontal during operation. A material entrance is provided at the elevated end. A screen comprising a plurality of hinged rigid plates, laterally extending across the frame, extends from side to side and front to back of the frame and is supported within the frame. The end of the screen at the elevated end of the separator is secured to the frame. The plates are spaced from adjacent plates a pre-determined distance. Screen distortion means comprising a plurality of spaced rows of rounded projections are mounted on the carriage. These projections bear against the bottom surface of the screen whereby, during operation, they move with the carriage back and forth beneath the hinged plates to create a wave action on the screen to move material across the screen from front to back. Water spray means is secured to the frame to spray from overhead onto material on the screen to assist passage of valuable ore and other material through the spaces between the plates into a receptacle beneath the screen and screen distortion means. Since only smaller material ultimately is collected and passed to the sluice box using a separator according to the present invention, relatively little water is needed for the sluicing part of the recovery of valuable ore.

10 Claims, 5 Drawing Figures

ROCK SEPARATOR

BACKGROUND OF THE INVENTION

The present invention relates to separators, and more particularly to a separator which is adapted for use in placer mining to separate valuable ore material and fine particulate matter from gravel or other waste, for subsequent passage through a sluice box.

According to traditional, prior art methods of placer mining of gold or other valuable metals or materials from creeks, gravel from the creek bed is treated in a sluice box. This process requires a good deal of water to properly wash the gravel and thereby ensure that the metal sought will settle to the bottom. In remote creeks where such placer mining may take, there may be only a limited water supply.

Screening machines for separating ore from gravel or other waste have been developed and are described in prior art references such as Canadian Pat. No. 672,981 of McQueen issued Oct. 29, 1963; Couture U.S. Pat. No. 3,106,523 issued Oct. 8, 1963 and Foreman Canadian Pat. No. 1,021,724 issued Nov. 29, 1977. Other patents of general background interest are Canadian Pat. No. 982,986 of Krause et al issued Feb. 3, 1976 and U.S. Pat. No. 3,633,745 of Wehner issued Jan. 11, 1972 and Canadian Pat. No. 583,467 of Bruninghaus issued Sept. 15, 1959.

It is an object of the present invention to provide a novel, effective ore separator which will assist in meeting the problem of sluicing rocky materials with limited water supply. It is also an object of the present invention to provide such a separator which may be transported to remote regions where placer mining is to take place and at such places be hooked up to either a gravity water line or a small pump for operation.

SUMMARY OF THE INVENTION

According to the present invention, a rock separator for placer mining is provided. The separator comprises a frame having sides ends and front and back and adapted to be inclined at an angle to the horizontal during operation. A material entrance is provided at the end to be elevated. A screen extends from side to side and front to back of the frame and is supported within the frame. The end of the screen at the elevated end of the separator is secured to the frame. The screen comprises a plurality of rigid plates which laterally extend across the frame. The plates are hinged to adjacent plates and are spaced therefrom a pre-determined distance. A carriage is situated beneath the screen and is adapted for longitudinal back and forth movement with respect to the frame. Screen distortion means comprising a plurality of spaced rows of rounded projections are mounted on the carriage. These projections bear against the bottom surface of the screen whereby, during operation, they move with the carriage back and forth beneath the hinged plates to create a wave action on the screen to move material across the screen from front to back. The separator also comprises receptacle means under the screen and screen through distortion means to collect material falling through the spaces the between the plates of the screen. Water spray means is preferably secured to the frame to spray from overhead onto material on the screen to assist passage of valuable ore and other material through the spaces between the plates into a receptacle means beneath the screen and screen distoration means, where the ore is then passed to a sluice box.

In one, preferred embodiment, the screen distortion means comprises a plurality of rubberized wheels aligned laterally in rows and secured to the carriage for rotation about lateral axes, an axis rotation being common to the wheels of each row.

One set of wheels is preferably attached to a hinging mechanism beneath the front end of the screen to even out the flow of rocks across the screen. This row of wheels is hinged to become depressed with respect to the level of the remaining wheels under the weight of a load of material on the screen above it, and to recover to the level of the remaining wheels as the weight of that load of material diminishes while the wave action of the screen moves material across the screen.

Appropriate power means is provided to drive the carriage during operation.

The device according to the present invention is portable in that it can be transported to remote creeks where placer mining is to take place and, at such places, be hooked up to either a gravity water line or a small pump for operation. Without such a machine, all the gravel from the creek bed must run through a sluice box. This requires a good deal of water to wash the material and thereby ensure that the gold bearing ore or other material sought will settle to the bottom. This machine washes the rocks and at the same time filters out from further processing all rocks above a diameter determined by the spacing between the screen plates. Thus only the smaller material ultimately goes to the sluice box and relatively little water is needed for that part of the process.

BRIEF DESCRIPTION OF THE DRAWINGS

Other objects and advantages of the present invention will becomes apparent upon reading the following detailed description and upon referring to the drawings in which.

Figure 1:
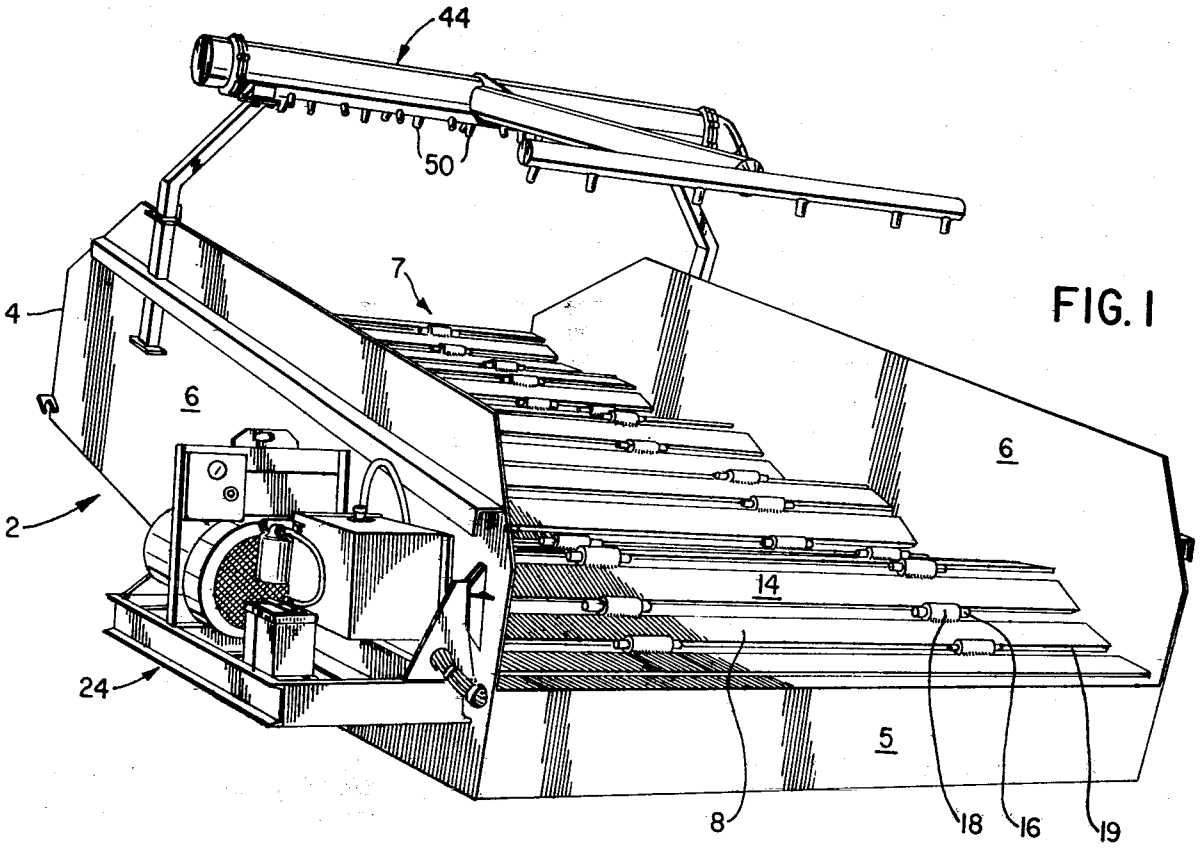
FIG. 1 is a perspective view of a preferred embodiment of a rock separator device according to the present invention.

While the invention will be described in connection with a preferred embodiment, it will be understood that it is not intended to limit the invention to that embodiment. On the contrary it is intended to cover all alternatives, modifications and equivalents as may be included within the spirit and scope of the invention as defined by the appended claims.

DETAILED DESCRIPTION OF THE INVENTION

In the drawings, similar details have been given similar reference numerals.

Turning to FIG. 1, there is shown an example embodiment of a rock separator according to the present invention, for use in placer mining. The device comprises a frame 2 having front and rear ends 4 and 5 respectively, and sides 6. The frame is adapted to be inclined at an angle to horizontal during operation, with front end 4 being elevated. Material entrance 7 is provided at the front of the frame, to receive rocks and gravel to be screened.

Figure 2:
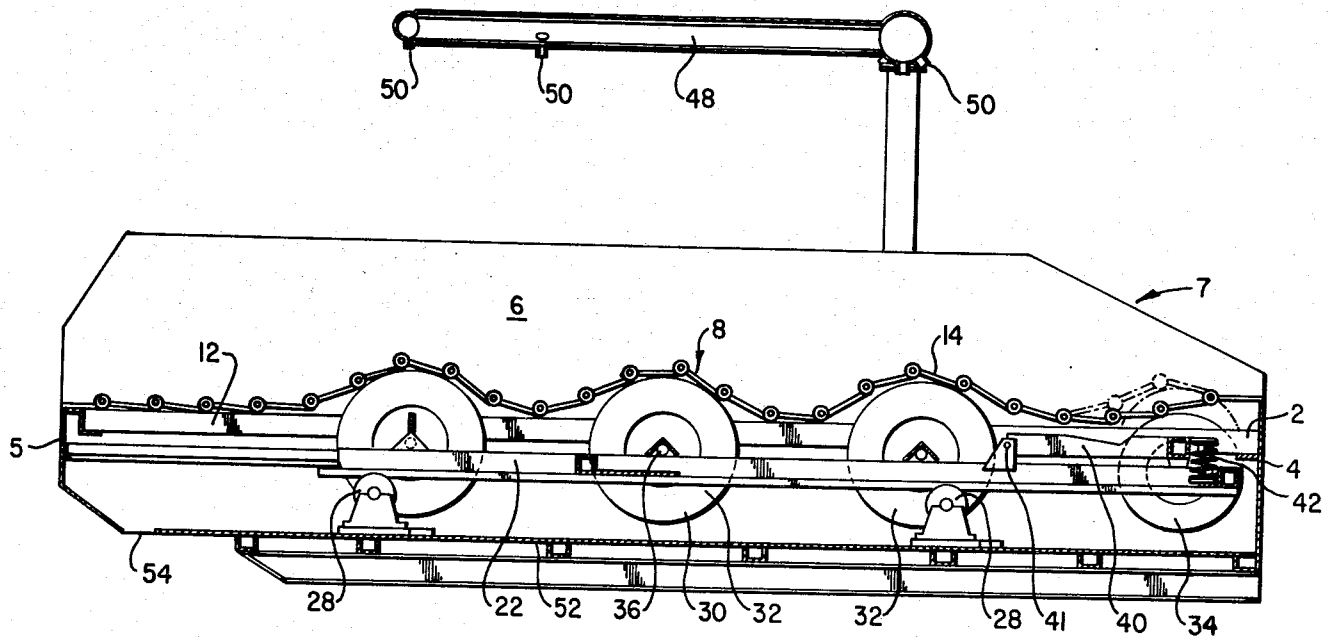
FIGS. 2 and 2A are side views in section of the device of FIG. 1 with the carriage in forward and rearward positions respectively.
Figure 2A:
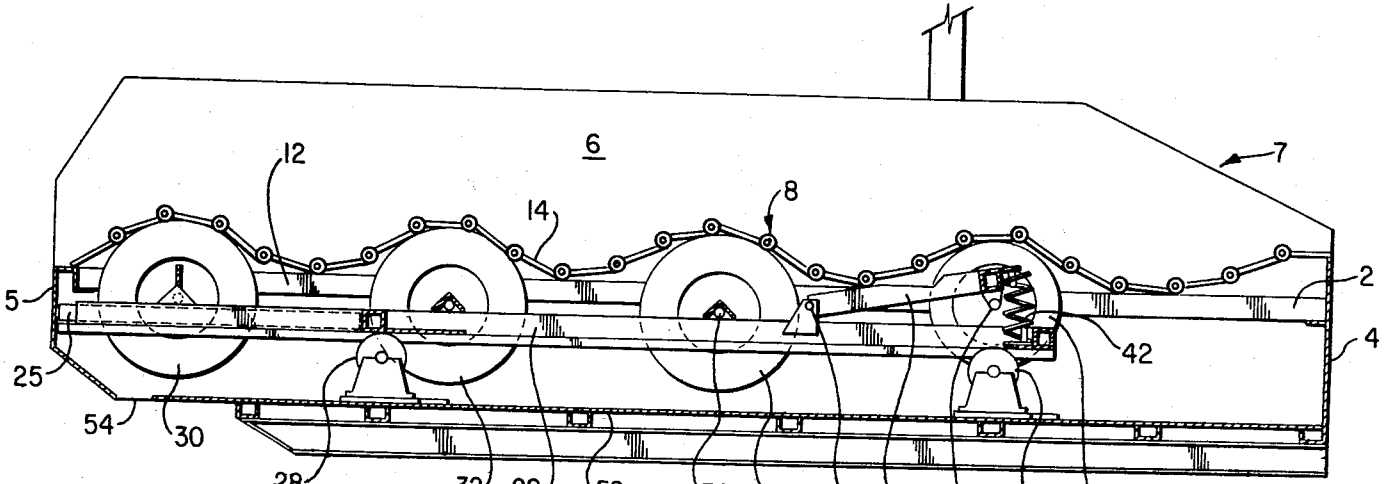
Figure 4:
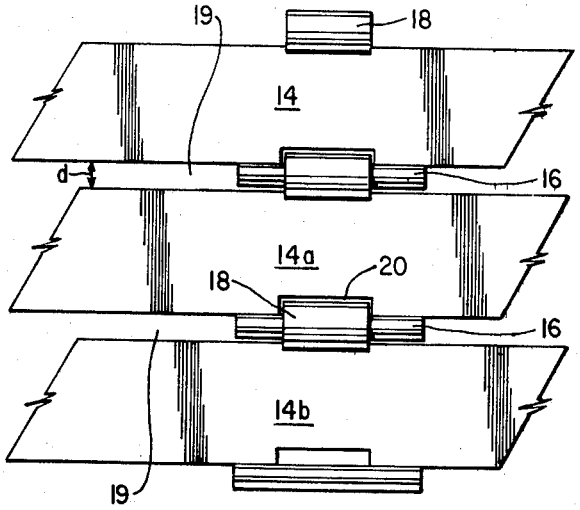
FIG. 4 is a detail view of the hinge means linking plates of the screen of the separator as illustrated.

Screen 8 is provided extending from side to side and front to back of the frame. The sides of the screen are from time to time supported on screen support bars 12 (FIGS. 2 and 2A). The screen comprises a plurality of rigid steel plates 14 extending laterally across the frame. Plates 14 are hinged to adjacent plates by means of rods 16 secured to one of adjacent pairs of plates 14, which rods 16 are circumscribed by bushings 18 secured to the other of such adjacent pairs. A slot 20 is provided in this other plate to provide clearance for the corresponding portion of bushing 18, as can be seen in FIG. 4. In addition to permitting unobstructed pivoting of plate 14*a* (FIG. 4) and its attached rod 16 with respect to plate 14*b* and bushing 18 secured thereto, slot 20 restricts lateral movement of plates 14*a* and 14*b* in opposite directions with respect to each other. This hinge arrangement using rods 16 and bushings 18 also enables provision of a space 19 of predetermined width "d" between adjacent plates 14. For placer mining of gold, a space 19 of about two inches width has been found suitable. It is through space 19 that anything of diameter smaller than "d" will drop during operation.

As can be seen in FIGS. 2 and 2A, beneath screen 8 is located carriage 22, adapted for back and forth movement with respect to frame 2. This movement is powered, in the embodiment illustrated, by appropriate power unit 24 and hydraulic means 25 (FIG. 2A). The carriage operates on rails 26 moving back and forth on wheels 28 secured to the frame, this movement being between a front position (FIG. 2) and a rear position (FIG. 2A).

Carriage 22, in the illustrated embodiment, travels back and forth inside frame 2 about four feet in each direction. When it reaches one end of its travel appropriate switch means, not illustrated but known to one skilled in the art, reverses the process, and so forth.

Figure 3:
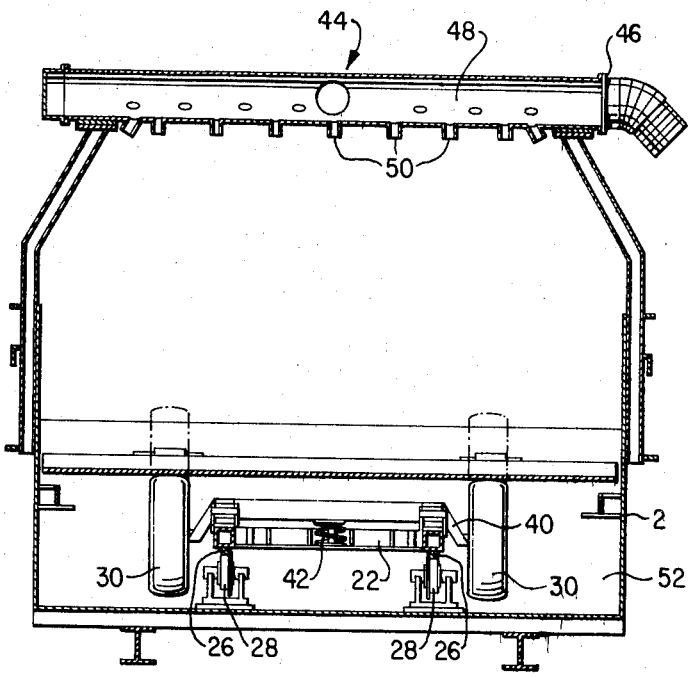
FIG. 3 is an end section view of the separator of FIG. 1.

To carriage 22 is mounted screen distortion means which comprises rubberized wheels or tires 30 aligned laterally in rows 32 and 34 and secured to the carriage 22 for rotation about lateral axis through their axles 36. As can be seen in FIGS. 2, 2A and 3, the wheels are of similar diameter in a particular row. In the embodiment illustrated, three rows 32 of tires of larger diameter are provided, with one row 34 of tires of smaller diameter.

During operation, tires 30 bear against the bottom surface of the screen 8 as illustrated, and, as they move back and forth beneath plates 14, they create a wave action on the screen to move material, as will be hereinafter described, across the screen from front to back. It will be apparent to one skilled in the art that the width of plates 14 must be sufficiently small in relation to the diameter of tires 30 so that the tires will effectively distort screen 8 to create the desired wave action.

As can be seen in FIGS. 2, 2A and 3, the row 34 of tires opposite to material entrance 7 is secured by arm 40 at hinge 41 to carriage 22. Compression spring 42 is provided to act on arm 40 such that row 34 will become depressed with respect to the level of the remaining wheels 30 under the weight of a load of material on the screen above it (FIG. 2), and to recover to the level of the remaining wheels as the weight of that load of material diminishes as shown in phantom in FIG. 2. Otherwise, there would ordinarily be a large amount of material travelling across screen 8 when a load is dumped into the entrance 7 of the machine, for example by a bulldozer, and very little travelling across the screen until the next load is dumped in.

Above the surface of screen 8, and secured to frame 2 with sufficient clearance to permit flow of material thereunder, is appropriate spray means 44, connectable to appropriate water supply means such as a gravity water line or a small pump by coupling 46. Tubes 48 carry water supplied in this manner to outlets 50 which spray the water onto the material on the screen 8.

Beneath screen 8 and carriage 22 is located receptacle 52 which receives material which passes through the spaces between plates 14. Receptacle 52 consequently extends preferably beneath the entire area of screen 8. It is provided with an outlet 54, at the back end thereof, to enable passage of material collected in the receptacle to a sluice box.

OPERATION

In operation, the device according to the present invention is mounted at an angle of say between 15° and 25° from the horizontal (an angle of 18° from the horizontal has proved very effective). Loads of gravel from creek beds are picked up by a bulldozer or loader and dumped into entrance 7 onto the front, elevated end of screen 8. As the wheels 30 move along beneath the hinged steel plates 14, they create a wave action and rocks or other materials which are larger in diameter than the width of the spaces between the plates ("d") follow along on top of the screen with the wave action until they ultimately drop out of the back of the machine. This machine washes the material and at the same time all material having a diameter of less than "d" pass through the spaces between plates 14 into receptacle 52 where such material slides to the lower end and out opening 54 into a sluice box.

The row of wheels 34 which has the function of ensuring a steady flow rocks across screen 8 operates as follows:

If the load of rocks and gravel to be separated is dumped while the carriage is at the upper, front end of the machine, the weight of the load depresses hinged arm 40 and row of wheels 34. If it is dumped when carriage 22 is at the rear 5 of the frame, then although the hinged wheels are in their upper, non-depressed position, as the carriage comes back to front end 4 of frame 2, the weight of the load will depress hinged arm 40. In either case, when the carriage begins its travel towards rear 5 with the load of material depressing hinge arm 40, much of the material falls back and is not taken along by the wave action. Some of the material however is moved forward through the machine and as more and more of the material is moved forward, the hinged wheels slowly rise in this front position. In this way, a steadier flow is achieved from the top, loading end of the machine, to the bottom, rear end thereof, where the material ultimately leaves.

In operation, it has been found that carriage travel back and forth within a period of about nine seconds is appropriate to provide a fairly even flow of material.

Thus there has been provided, in accordance with the invention, a rock separator device that fully satisfies the objects, aims and advantages set forth above. While the invention has been described in conjunction with an example embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention is:

1. A rock separator of the type intended to be elevated at one end during use in placer mining comprising:

a frame having sides and front and back ends, a material entrance being provided at the front end of the frame;

a screen extending from side to side and front to back of the frame and supported within the frame, the end of the screen at the elevated end of the separator being secured to the frame, the screen comprising a plurality of rigid plates laterally extending across the frame, the plates being hinged to adjacent plates and spaced therefrom a pre-determined distance;

a carriage situated beneath the screen and means for longitudinally reciprocating said carriage with respect to the frame;

screen distortion means comprising a plurality of spaced rows of rounded projections mounted on the carriage, these projections bearing against the bottom surface of the screen whereby, during operation, they move back and forth beneath the hinged plates to create a wave action on the screen to move material across the screen from front to back;

receptacle means under the screen and screen distortion means to collect material falling through the spaces between the plates of the screen.

2. A rock separator according to claim 1 wherein the screen distortion means comprises a plurality of wheels aligned laterally in rows and secured to the carriage for rotation about lateral axes, an axis of rotation being common to the wheels of each row.

3. A rock separator according to claim 2 further comprising water spray means positioned above the screen to spray material being separated on the screen and wash ore material through the spaces between the plates into the receptacle means.

4. A rock separator according to claim 2 wherein an outlet is provided in the receptacle means to pass collected material.

5. A rock separator according to claim 2 wherein the separator is adapted to be inclined at an angle of about 18° to horizontal during operation.

6. A rock separator according to claim 1 further provided with a power unit to drive the carriage.

7. A rock separator according to claim 6 further provided with a switch control means to reverse the direction of travel of the carriage when it reaches each end of its travel.

8. A rock separator according to claim 2 wherein one row of wheels is located on the carriage opposite the material entrance, this row of wheels being hinged to become depressed with respect to the level of the remaining wheels under the weight of a load of material on the screen above it and to recover to the level of the remaining wheels as the weight of that load of material diminishes, whereby flow of material through the separator during operation is evened out.

9. A rock separator according to claim 8 wherein the wheels are rubber tires and the wheels in a row are of similar diameter.

10. A rock separator according to claim 2 wherein the plates are of steel and are hinged to adjacent plates by means of rods secured to one plate circumscribed by bushings secured to the adjacent plates.

* * * * *